US012161201B2

(12) United States Patent
Hiromi et al.

(10) Patent No.: US 12,161,201 B2
(45) Date of Patent: Dec. 10, 2024

(54) METALLIC ELEMENT AND SLIDE FASTENER

(71) Applicant: YKK Corporation, Tokyo (JP)

(72) Inventors: Chikako Hiromi, Kurobe (JP); Futoshi Kozato, Kurobe (JP); Shigeru Tsuchida, Kurobe (JP)

(73) Assignee: YKK CORPORATION (JP)

( * ) Notice: Subject to any disclaimer, the term of this patent is extended or adjusted under 35 U.S.C. 154(b) by 250 days.

(21) Appl. No.: 17/767,484

(22) PCT Filed: Oct. 10, 2019

(86) PCT No.: PCT/JP2019/040109
§ 371 (c)(1),
(2) Date: Apr. 8, 2022

(87) PCT Pub. No.: WO2021/070345
PCT Pub. Date: Apr. 15, 2021

(65) Prior Publication Data

US 2023/0068548 A1 Mar. 2, 2023

(51) Int. Cl.
*A44B 19/02* (2006.01)
*A44B 19/06* (2006.01)

(52) U.S. Cl.
CPC ..... *A44B 19/06* (2013.01)

(58) Field of Classification Search
CPC ..... A44B 19/06
See application file for complete search history.

(56) References Cited

U.S. PATENT DOCUMENTS 1,219,881 A * 3/1917 Sundback ..... A44B 19/04 24/429
1,814,244 A * 7/1931 Cobb ..... B21D 53/52 29/408
1,983,070 A * 12/1934 Cox ..... A44B 19/02 24/405
2,045,884 A * 6/1936 Sundback ..... A44B 19/46 29/241
2,075,762 A * 3/1937 Kelley ..... A44B 19/06 24/414

(Continued)

FOREIGN PATENT DOCUMENTS

CN 1449699 A 10/2003
CN 102595956 A 7/2012

(Continued)

OTHER PUBLICATIONS

Hiromi, Chikako; International Preliminary Report on Patentability for PCT/JP2019/040109, filed Oct. 10, 2019, mailed Apr. 21, 2022, 7 pgs.

(Continued)

*Primary Examiner* — Jason W San
(74) *Attorney, Agent, or Firm* — Taylor English Duma LLP

(57) ABSTRACT

Legs of a pair of legs are provided with core-thread-pressing surfaces that slant gradually to approach one another as being away from the stopping surfaces. Each core-thread-pressing surface extends from the stopping surface to the base end of the leg. A thickness of each leg in a thickness direction of the fastener tape gradually increases from the free end toward the base end of the leg in accordance with at least the slanting of the core-thread-pressing surface.

14 Claims, 9 Drawing Sheets

(56) References Cited

U.S. PATENT DOCUMENTS

| | | | | | |
|---|---|---|---|---|---|
| 2,075,763 | A * | 3/1937 | Kelley | A44B 19/34 | 29/515 |
| 2,108,009 | A * | 2/1938 | Miller | A44B 19/06 | 29/444 |
| RE21,325 | E * | 1/1940 | Miller | A44B 19/06 | 24/414 |
| 2,622,295 | A * | 12/1952 | Mikulas | A44B 19/04 | 24/410 |
| 4,010,520 | A * | 3/1977 | Yoshida | A44B 19/06 | 24/414 |
| 5,713,110 | A * | 2/1998 | Covi | A44B 19/08 | 24/431 |
| 7,322,075 | B2 * | 1/2008 | Ozaki | A44B 19/06 | 24/414 |
| 9,101,182 | B2 * | 8/2015 | Kozato | A44B 19/06 | |
| 2003/0192150 | A1 * | 10/2003 | Aoki | A44B 19/06 | 24/403 |
| 2005/0183246 | A1 * | 8/2005 | Ozaki | B21D 53/52 | 24/403 |
| 2012/0137476 | A1 | 6/2012 | La Rocca et al. | | |
| 2012/0167354 | A1 * | 7/2012 | Keyaki | A44B 19/388 | 24/386 |
| 2016/0015133 | A1 * | 1/2016 | Chung | A44B 19/06 | 24/411 |

FOREIGN PATENT DOCUMENTS

| | | | |
|---|---|---|---|
| CN | 104955352 | A | 9/2015 |
| CN | 107847017 | A | 3/2018 |
| EP | 2946683 | | 11/2015 |
| EP | 3332664 | | 6/2018 |
| EP | 3556242 | | 10/2019 |
| JP | 01-080012 | U | 5/1989 |
| JP | 3917452 | B2 | 5/2007 |
| JP | 3198065 | U | 6/2015 |
| WO | 2013080302 | | 6/2013 |
| WO | 2018109923 | | 6/2018 |
| WO | 2019043851 | | 3/2019 |

OTHER PUBLICATIONS

Hiromi, Chikako; International Search Report and Written Opinion for PCT/JP2019/040109, filed Oct. 10, 2019, mailed Dec. 17, 2019, 12 pgs.

YKK Corporation; Office Action for Bangladesh application No. 217/2020/7431, mailed Nov. 21, 2021, 1 pg.

YKK Corporation; Office Action for Chinese patent application No. 201980099904.5, mailed Aug. 31, 2023, 16 pgs.

* cited by examiner

[Fig. 1]
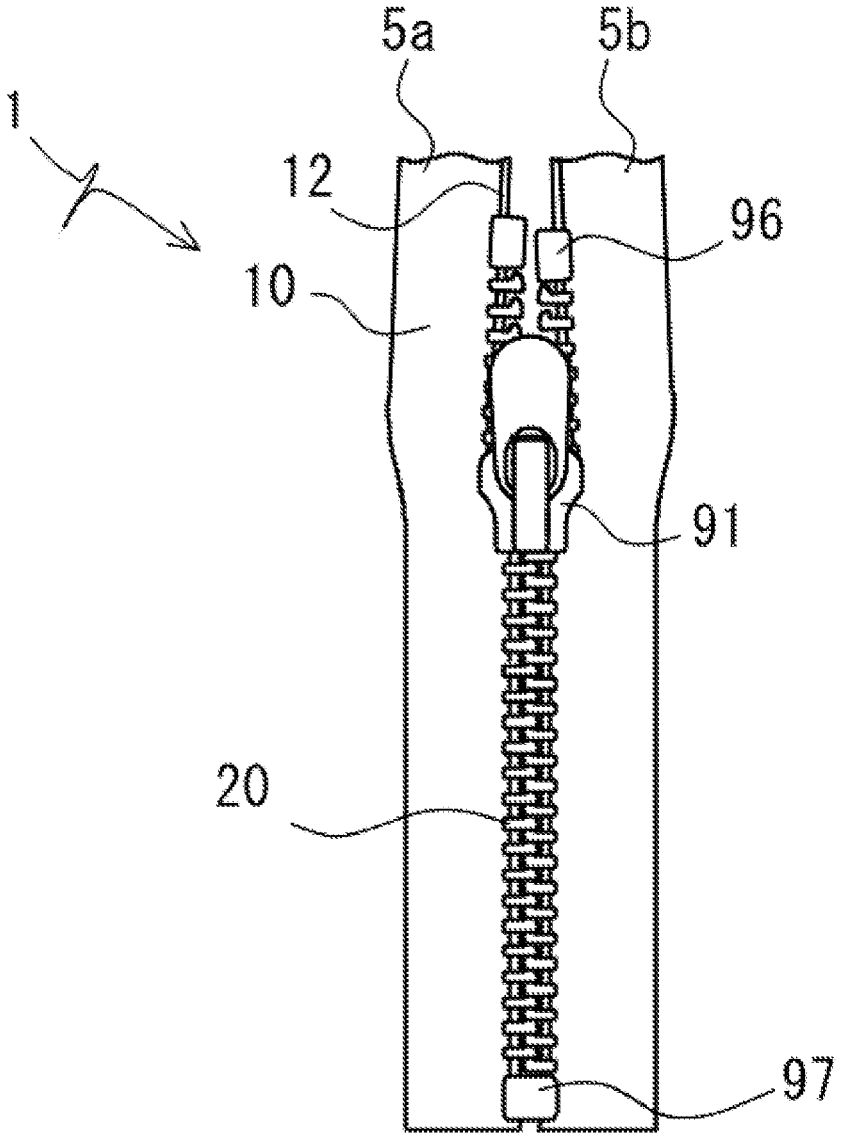

[Fig. 2]
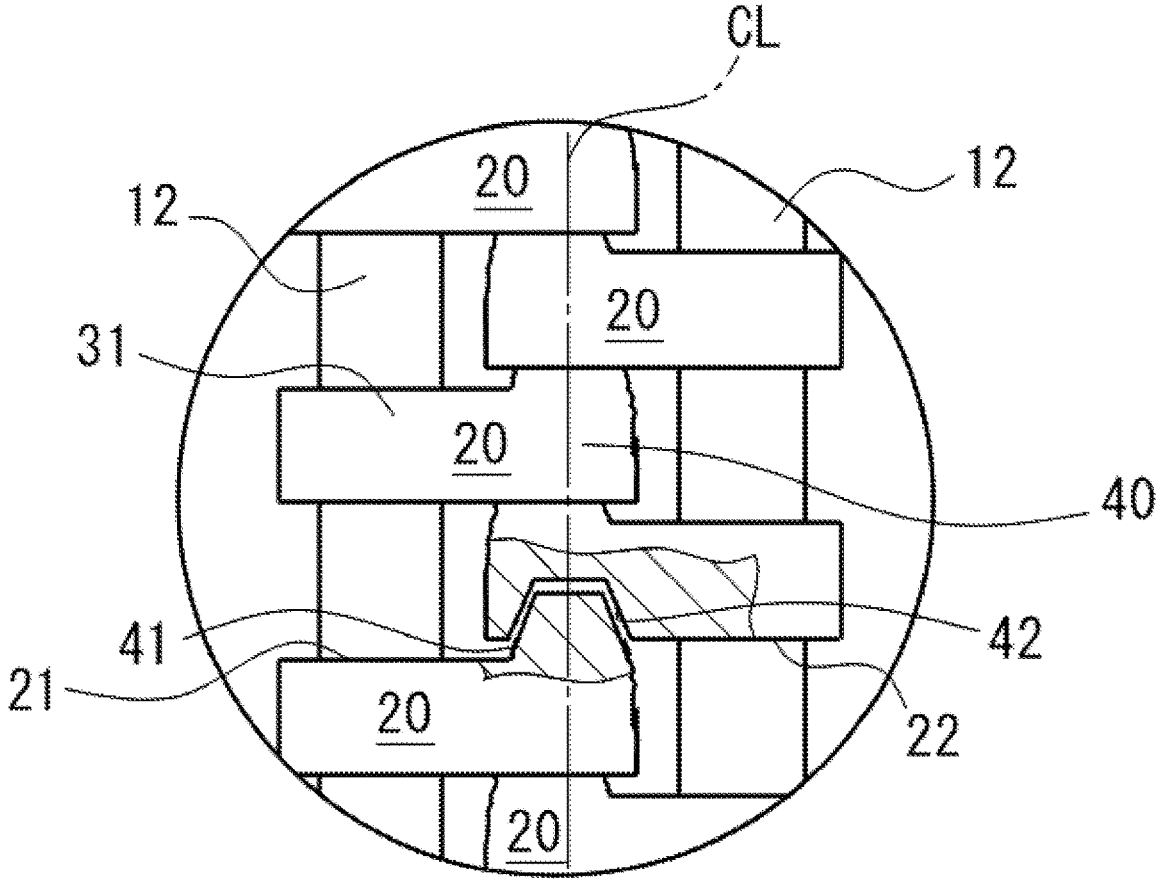

[Fig. 3]
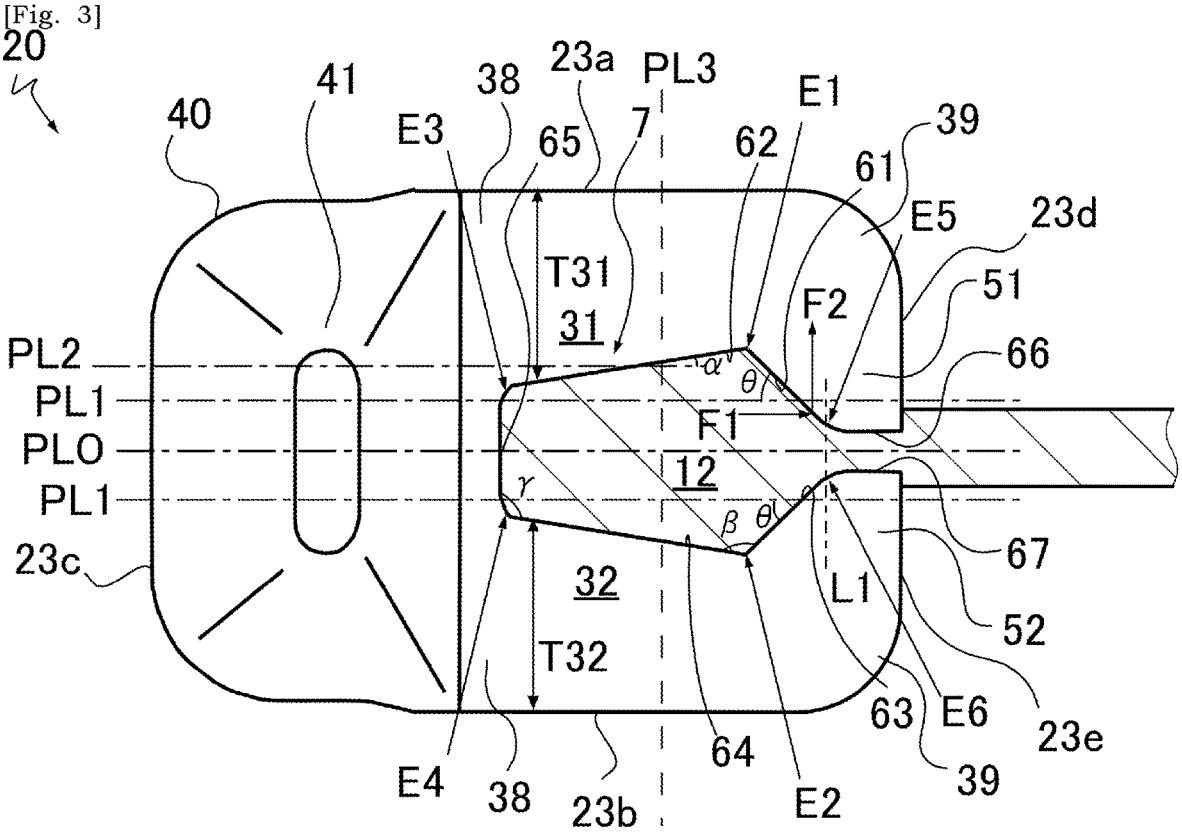

[Fig. 4]
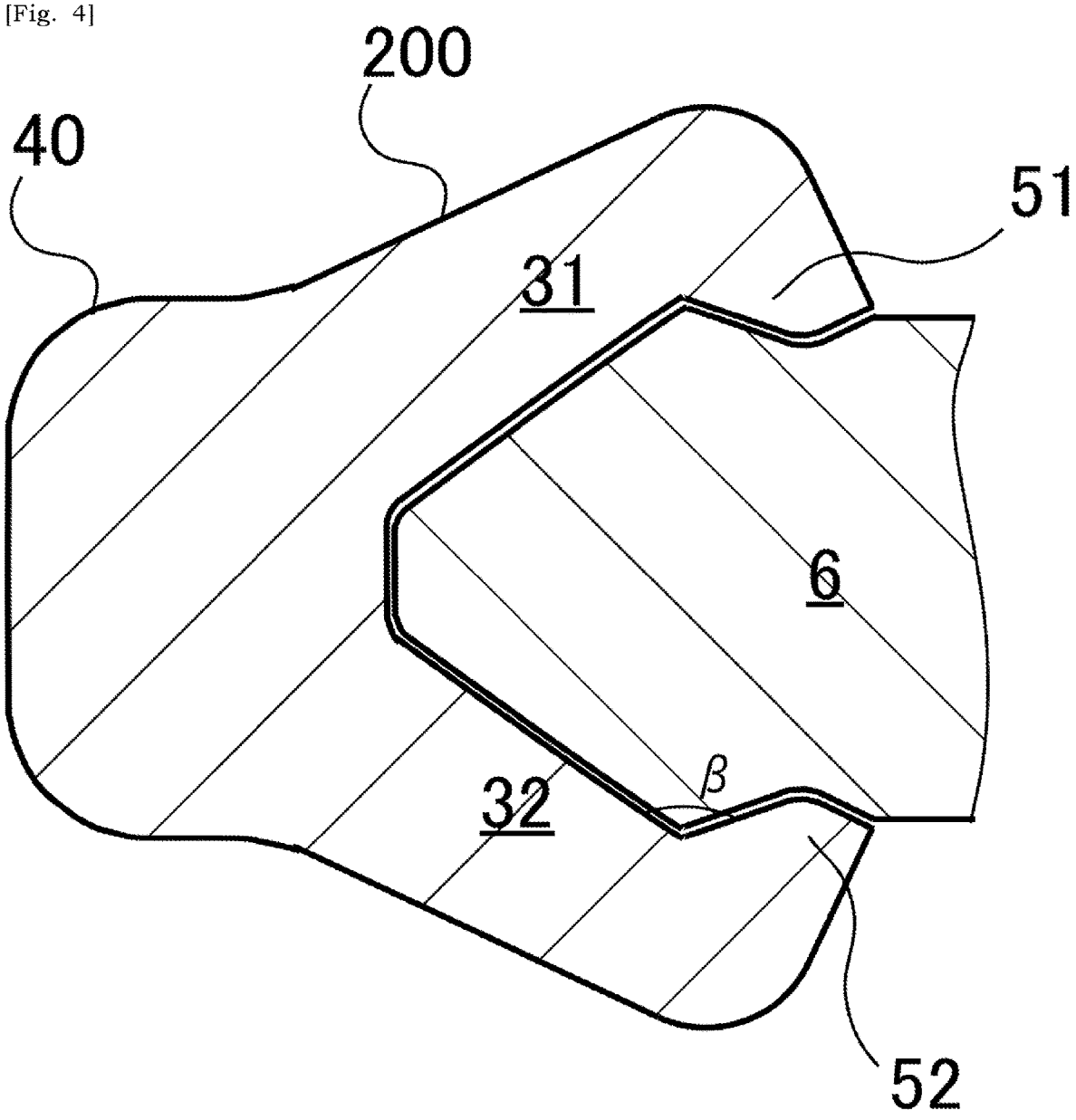

[Fig. 5]
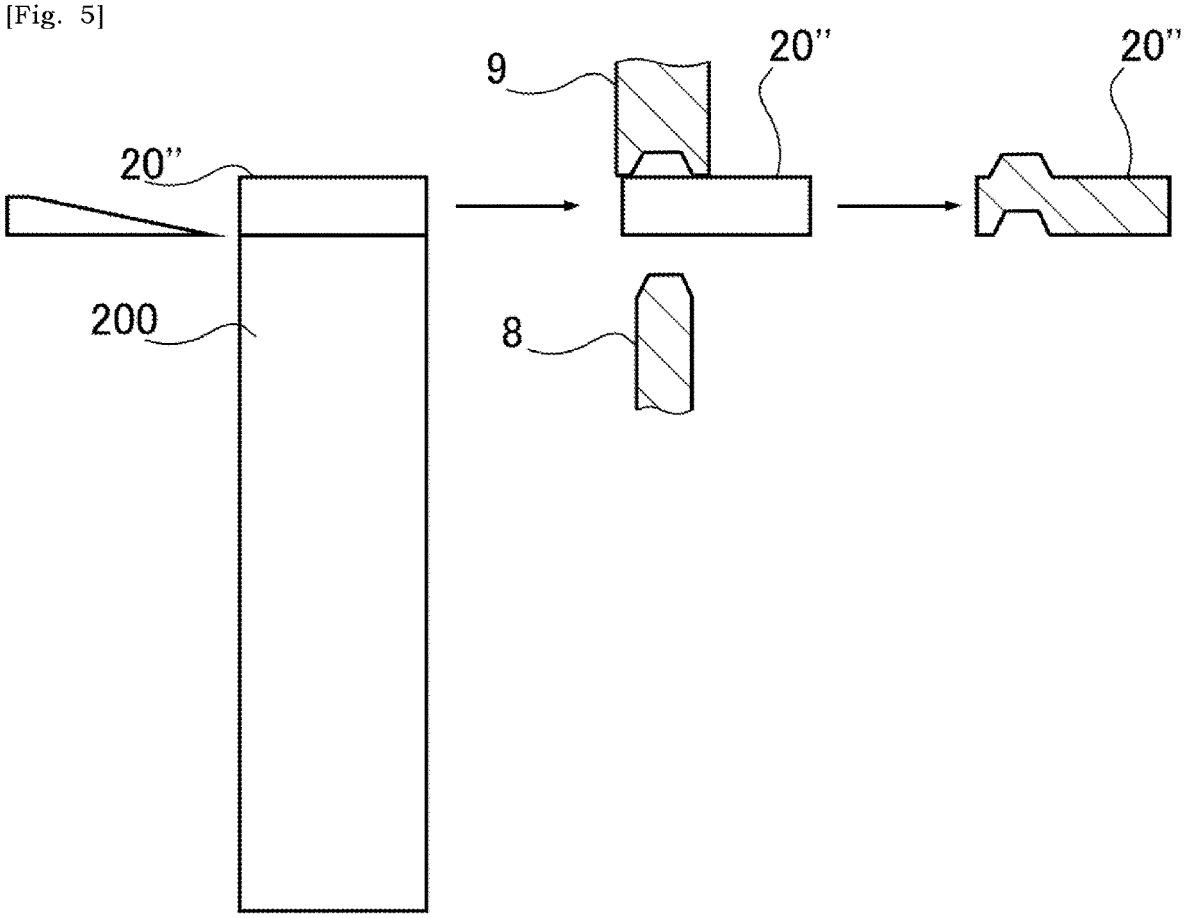

[Fig. 6]
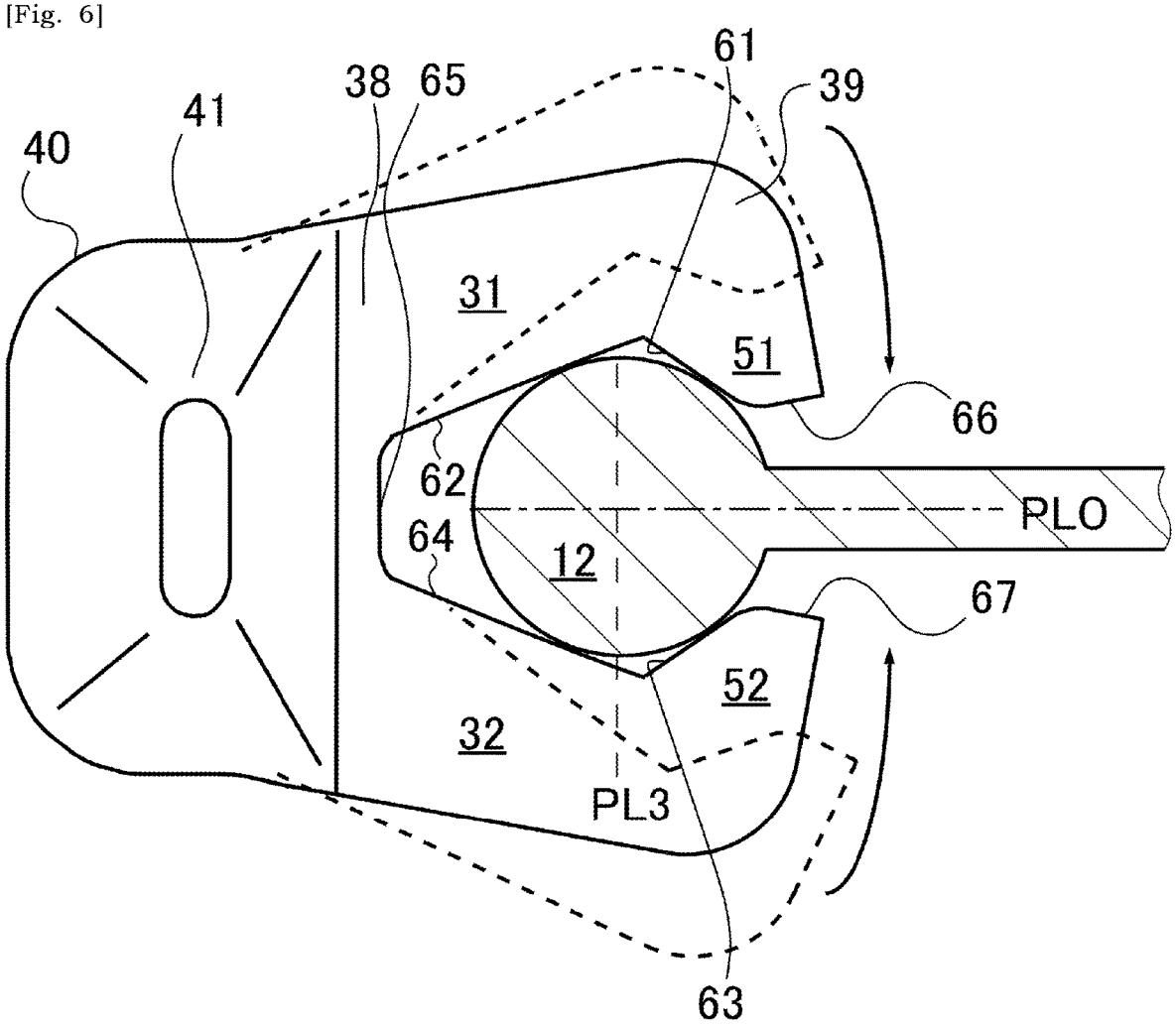

[Fig. 7]
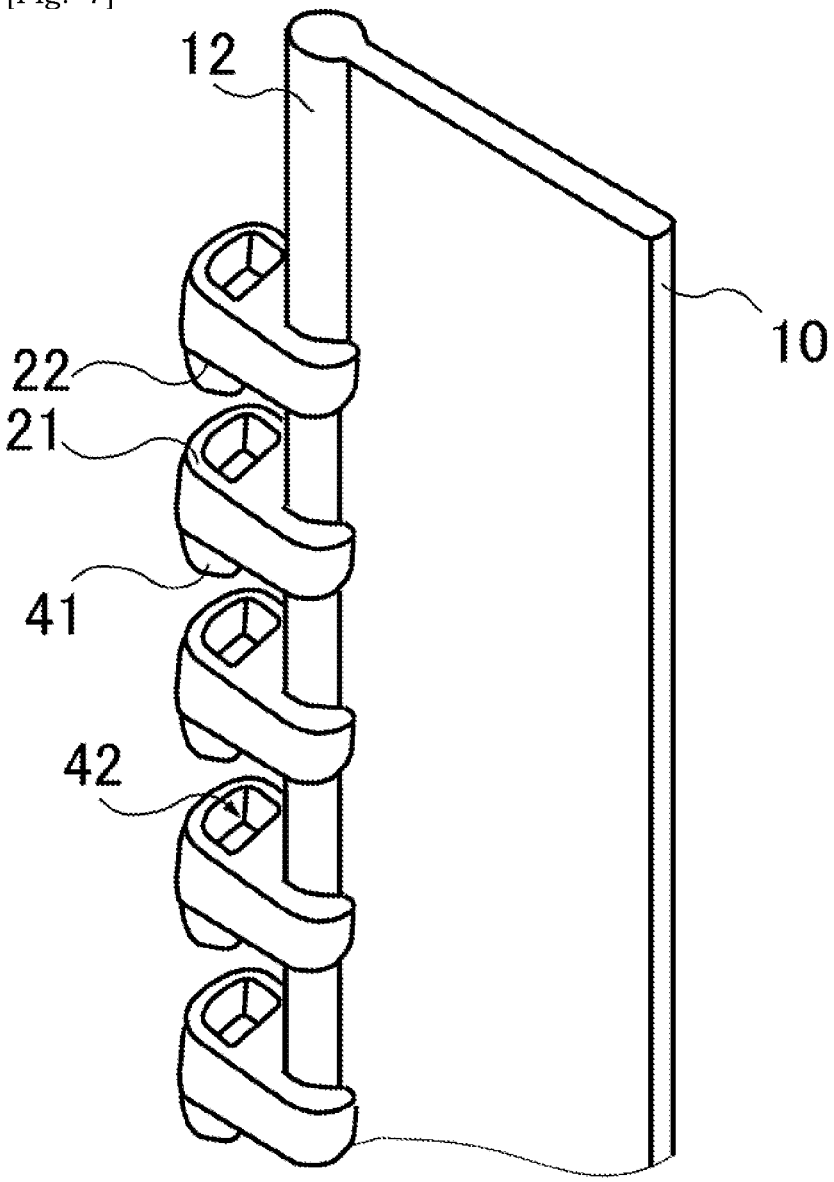

[Fig. 8]
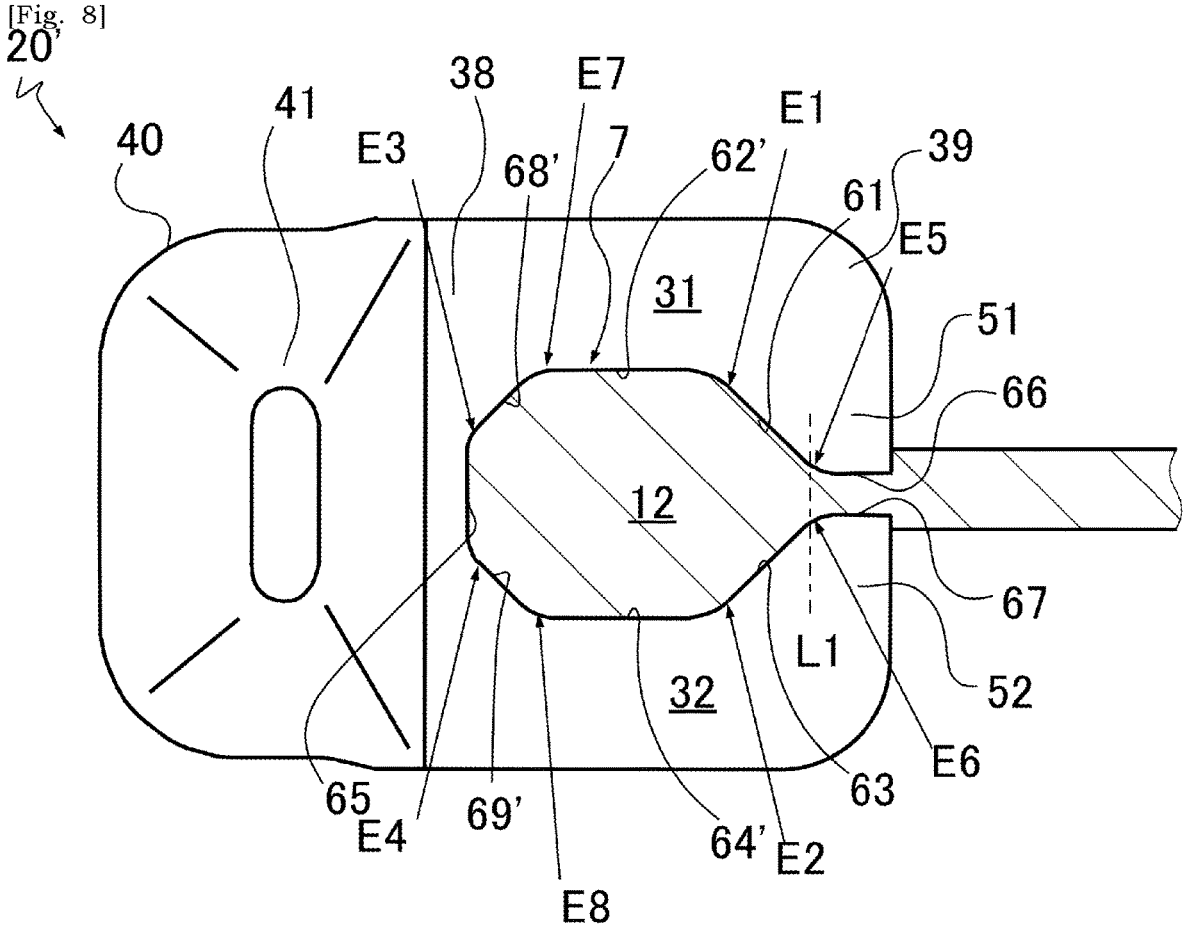

[Fig. 9]
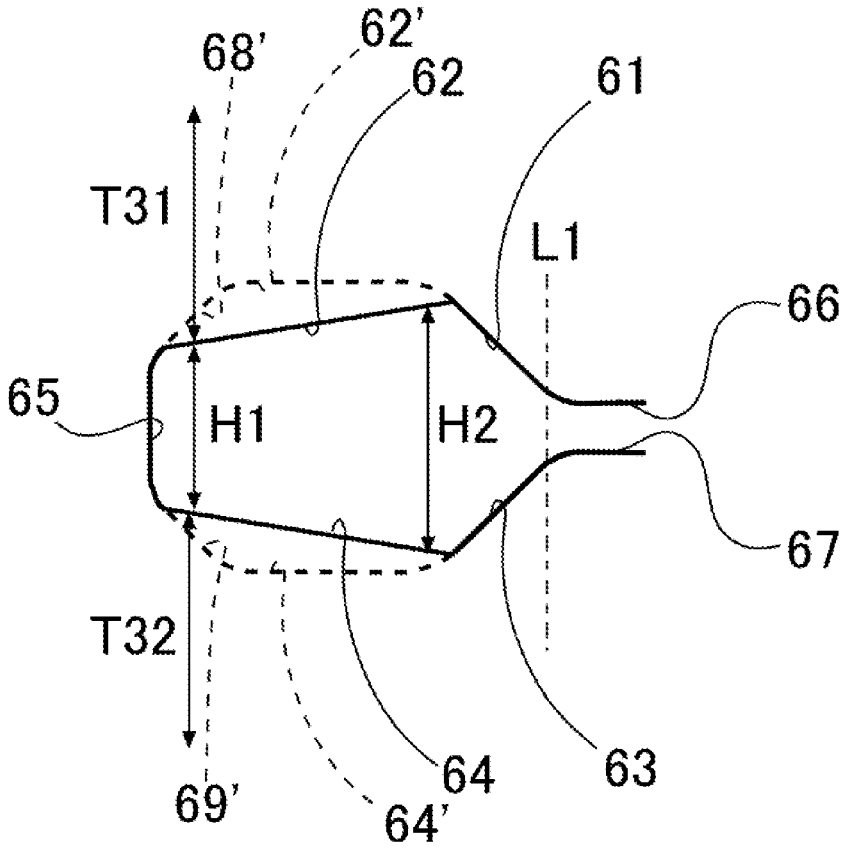

METALLIC ELEMENT AND SLIDE FASTENER

TECHNICAL FIELD

The present disclosure is directed to a metal element and slide fastener.

BACKGROUND ART

Patent literature 1 is related to a type of method of producing fastener elements wherein fastener elements are cut out from a metal wire rod, particularly a Y-shaped bar. Leg of the Y-shaped bar is provided with three or more bents to facilitate positioning of the Y-shaped bar during a process of rolling (See para. 0038 of the literature). Patent literature 2 is related to a type of method of producing fastener elements wherein a respective fastener element is obtained from a metal flat plate through punching (See FIG. 6 of the literature). Likewise patent literature 2, Patent literature 3 is related to a type of method of producing fastener elements wherein a respective fastener element is obtained from a metal flat plate through punching. In patent literature 3, tape-sandwiching portions are provided in which respective legs are bent like a hook, thus increasing the fixing force to the fastener tape (See FIG. 1 of the literature).

The type of method of producing fastener elements, in which fastener elements are cut out from a Y-shaped bar as disclosed in Patent literature 1 (e.g. Para. 0004), would be advantageous over the type of method of producing fastener elements disclosed in Patent literature 2 and 3 in some aspects such as reduction of material cost.

CITATION LIST

Patent Literature

[PTL 1] Japanese Patent No. 3917452
[PTL 2] International Publication No. 2018/109923
[PTL 3] Utility-model application Laid-open No. 1-80012

SUMMARY

Technical Problem

It has been explored to use new metal material for the metal elements. For example, use of lightweight metal material may reduce weight of a slide fastener, or use of cheaper metal material may reduce cost of metal elements and thus enhance cost-competitiveness of slide fasteners. However, hardness of the metal element depends more or less on its metal material. Therefore, there is a possibility that fundamental characteristics of a slide fastener, i.e. strength to resist a laterally-pulling force may not be ensured due to a metal material employed. In view of this, the present inventors have newly identified an advantage of increasing the strength of a slide fastener to resist a laterally-pulling force based on employment of a new structure of a metal element. Note that, the present invention should not be limited to a metal element made of new metal material, but will be effective and useful for metal elements made of conventional metal materials.

Solution to Problem

A metal element according to an aspect of the present disclosure is a metal element attached to a core thread of a fastener tape. The metal element includes a pair of legs sandwiching the core thread, and a head to which the pair of legs are coupled. Each leg is a cantilever extending toward its free end from its base end coupled to the head. The free end of each leg is provided with a stopping claw that has a stopping surface configured to prevent the core thread from moving away from a position between the pair of legs. The stopping surfaces of the pair of legs slant gradually to approach one another as being away from the head. The head is shaped like a cup with engaging protrusion and engaged recess which are arranged in a same axial line. The engaging protrusion protrudes from a first side-surface of the metal element which is formed flat across the head and the leg. The engaged recess is recessed in a second side-surface of the metal element which is formed flat across the head and the leg. The second side-surface is provided at the opposite side of the first side-surface. The pair of legs are provided with core-thread-pressing surfaces which slant gradually to approach one another as being away from the stopping surfaces. Each core-thread-pressing surface extends from the stopping surface to the base end of the leg. Thickness of the leg in a thickness direction of the fastener tape gradually increases from the free end toward the base end of the leg in accordance with at least the slanting of the core-thread-pressing surface.

In some embodiments, an angle between the stopping surface and a plane arranged in parallel with a plane the fastener tape exists is equal to or less than 60° and/or an angle between the core-thread-pressing surface and a plane arranged in parallel with the plane the fastener tape exists is in a range between 6° to 30°.

In some embodiments, $2.5<(\theta/\alpha)<7.5$ is satisfied in which: $\theta$ indicates an angle between the stopping surface and a plane arranged in parallel with a plane the fastener tape exists; and $\alpha$ indicates an angle between the core-thread-pressing surface and a plane arranged in parallel with the plane the fastener tape exists.

In some embodiments, an angle between the stopping surface and the core-thread-pressing surface is in a range between 100° and 135°.

In some embodiments, when an imaginary line is drawn so as to couple a boundary between the stopping surface and the terminal face of the stopping claw in one leg and a boundary between the stopping surface and the terminal face of the stopping claw in the other leg, a core-thread-holding portion is defined to have a hexagonal aperture.

In some embodiments, the first and second side-surfaces are sheared surfaces.

In some embodiments, the metal element includes Al or an alloy including Al, e.g. Al—Si based alloy.

A slide fastener according to another aspect of the present disclosure includes a metal element of any one of above-described elements.

Advantageous Effects of Invention

An aspect of the present disclosure provides a metal element that contributes to enhance or to keep in a tolerable range the strength of slide fastener to resist a laterally-pulling force.

BRIEF DESCRIPTION OF DRAWINGS

FIG. 1 is an elevational view of a slide fastener according to an aspect of the present disclosure.

FIG. 2 is a schematic view illustrating that left and right metal elements are engaged in a slide fastener.

FIG. 3 is a schematic view illustrating that a core thread is sandwiched between upper and lower legs of a metal element.

FIG. 4 is a cross-sectional schematic view illustrating that a metal wire rod is molded into a Y-shaped bar by rolling dies.

FIG. 5 is a schematic process view illustrating that an element plate is cut out from a Y-shaped bar, and engaging protrusion and engaged recess are formed based on local plastic deformation in a head.

FIG. 6 is a schematic process view illustrating a process in which a metal element is attached to a core thread.

FIG. 7 is a schematic perspective view illustrating that plural metal elements are attached to a core thread.

FIG. 8 is a schematic view of a metal element according to a reference example.

FIG. 9 is a reference diagram showing an open profile of core-thread holding portion of respective metal elements according to working example and reference example.

DESCRIPTION OF EMBODIMENTS

Hereinafter, various embodiments and features will be described with reference to FIGS. 1 to 9. A skilled person would be able to combine respective embodiments and/or respective features without requiring excess descriptions, and would appreciate synergistic effects of such combinations. Overlapping descriptions among the embodiments are basically omitted. Referenced drawings aim mainly for describing inventions and are simplified for the sake of convenience of illustration.

As shown in FIG. 1, a slide fastener 1 has a pair of left and right fastener stringers 5*a*, 5*b* and a slider 91 for opening and closing this stringers 5*a*, 5*b*. Each stringer 5*a*, 5*b* has a fastener tape 10 with a core thread 12 arranged on the side-edge, and metal elements 20 attached to the core thread 12. The fastener tape 10 is a woven or knitted fabric or combination thereof and has a flexibility. The thickness of the fastener tape 10 is defined by upper and lower tape surfaces. The metal elements 20 are arranged at a constant pitch along the lengthwise direction of the fastener tape 10. Frontward movement of the slider 91 closes the left and right stringers 5*a*, 5*b* and rearward movement of the slider 91 opens the left and right stringers 5*a*, 5*b*. The slider 91 may be made of metal or resin or ceramics. Note that, a slide fastener 1 should not be limited to a type shown in FIG. 1, but may be other types such as a conceal slide fastener. Front stops 96 are provided at the respective front ends of the stringers 5*a*, 5*b*. Rear stop 97 is provided at the rear ends of the stringers 5*a*, 5*b* and couples the two stringers. These stop members can be omitted. Front-Rear direction may be understood based on a direction the slider moves. Left-Right direction is orthogonal to the front-rear direction, and is parallel to the tape surfaces of the fastener tape 10. Up-Down direction is orthogonal to the front-rear direction and is perpendicular to the tape surfaces of the fastener tape 10.

As shown in FIGS. 2 and 3, each metal element 20 has a pair of legs 31, 32 (e.g. referred to as Upper leg 31 and Lower leg 32) sandwiching the core thread 12, and a head 40 to which the pair of legs 31, 32 are coupled. The head 40 is shaped like a cup with engaging protrusion 41 and engaged recess 42 which are arranged in the same axial line CL. The axial line CL, on which the engaging protrusion 41 and the engaged recess 42 are arranged, is parallel to the side-edge of the fastener tape 10 and the front-rear direction, and is set outside the tape surface of the fastener tape 10. The axial line CL matches the passage of the slider 91 and in short, is a central line of the slide fastener 1.

The engaging protrusion 41 protrudes from a first side-surface 21 of the metal element 20 which is formed flat across the head 40 and the leg 31, 32. The engaged recess 42 is recessed in a second side-surface 22 of the metal element 20 which is formed flat across the head 40 and the leg 31, 32. The second side-surface 22 is provided at the opposite side of the first side-surface 21. The first and second side-surfaces 21, 22 may be arranged to cross the tape surface of the fastener tape 10 at a right angle. The first side-surface 21 is one of the front-side surface and the rear-side surface of the metal element 20. The second side-surface 22 is the other one of the front-side surface and the rear-side surface of the metal element 20. As would be understood by a skilled person in the art, the present metal element 20 is produced through shearing a Y-shaped bar. That is, the first and second side-surfaces 21, 22 are sheared surfaces. In a case where a metal element 20 is produced through a process of punching a metal plate, complicate structure with bulges on both sides would be normally formed in the head as disclosed in the patent literature 3.

The metal element 20 has a peripheral surface that interconnects the rim of the first side-surface 21 and the rim of the second side-surface 22. As shown in FIG. 3, the peripheral surface includes an upper surface 23*a*, a lower surface 23*b*, head-terminal-surface 23*c*, and leg-terminal-surfaces 23*d*, 23*e*. The leg-terminal-surfaces 23*d*, 23*e* are arranged to sandwich the fastener tape 10 at the upper and lower sides.

Each leg 31, 32 is a cantilever extending toward its free end 39 from its base end 38 coupled to the head 40. The legs 31, 32 and the head 40 configure a core-thread-holding portion 7. The core thread holding portion 7 has stopping surfaces 61, 63, core-thread-pressing surfaces 62, 64 and a bottom surface 65. The core-thread-pressing surface 62, 64 and the stopping surface 61, 63 are arranged adjacent along the direction the leg 31, 32 extends. The bottom surface 65 extends in the thickness direction (i.e. Up-Down direction) of the fastener tape 10 and couples the respective core-thread-pressing surfaces 62, 64, and may be simply referred to as a connection surface.

The free end 39 of each leg 31, 32 is provided with a stopping claw 51, 52 that has a stopping surface 61, 63 configured to prevent the core thread 12 from moving away from a position between the pair of legs 31, 32. The stopping surfaces 61, 63 of the pair of legs 31, 32 slant gradually to approach one another as being away from the head 40. Each stopping surface 61, 63 may be a flat surface. Preferably, an angle θ between the stopping surface 61, 63 and a plane PL1 arranged in parallel with a plane PL0 the fastener tape 10 exists is equal to or less than 60° or less than 60°, more preferably equal to or less than 56°. Also, the angle θ is preferably equal to or greater than 45°. Note that, an acute angle will be referenced as the angle θ. Attachment strength of the metal elements 20 to the core thread 12 and smoother molding of Y-shaped bar from a metal wire can be balanced. In a case where the angle θ between the plane PL1 and the stopping surface 61, 63 is 90°, a stopping force of the stopping surface 61, 63 would be increased, but molding of Y-shaped bar from a metal wire cannot be easily done.

In the present embodiment, the pair of legs 31, 32 are provided with core-thread-pressing surfaces 62, 64 which slant gradually to approach one another as being away from the stopping surfaces 61, 63. Each core-thread-pressing surface 62, 64 extends from the stopping surface 61, 63 to the base end 38 of the leg 31, 32 (or to the bottom surface 65). In accordance with this slanting of the core-thread-pressing surface 62, 64, the thickness T31, T32 of the leg 31, 32 in the thickness direction of the fastener tape 10 gradually increases from the free end 39 toward the base end 38 of the leg 31, 32. Accordingly, the legs 31, 32 can have a higher resistance against a laterally-pulling force applied to the slide fastener 1. Note that, at the time of pulling the slide fastener 1 laterally, the slide fastener 1 in closed condition is pulled oppositely in the left-right direction and attachment strength of the left and right metal element 20 to the core thread 12 is mainly evaluated.

As noted above, the stopping surfaces 61, 63 of the pair of legs 31, 32 slant gradually to approach one another as being away from the head 40. In this case, it is likely that, when pulling the slide fastener 1 laterally, the stopping surface 61, 63 receives a force F1 from the core thread 12, and a force F2 is exerted to the leg 31, 32 which is to move one away from the other between the respective free ends 39 of the legs 31, 32. In the present embodiment, owing to the core-thread-pressing surface 62, 64, the thickness T31, T32 of the leg 31, 32 gradually increase from the free end 39 toward the base end 38. Therefore, even though the stopping surfaces 61, 63 slant as described above, the leg 31, 32 can endure a greater force F2 and increase of the interspace between the legs 31, 32 is suppressed. That is, it is facilitated that the strength of slide fastener 1 to resist a laterally-pulling force is increased while ensuring easier molding of Y-shaped bar.

In cases where the aforementioned core-thread-pressing surfaces 62, 64 are employed, the core thread holding portions 7 will be asymmetrical with respect to a plane PL3 (see a vertical plane shown by a dotted line in FIG. 3), thus possibly causing unevenness/difference in the magnitude of force of pressing the core thread 12. Note that, the planes PL0 and PL3 cross at the center of the core thread 12 (see FIG. 6). According to analysis by the present inventors, the legs 31, 32 with greater strength in resisting the force F2 is given more weight in terms of improvement of the strength of the slide fastener 1 against a laterally-pulling force than the unevenness/difference in the magnitude of force of pressing the core thread 12.

Angle $\alpha$ between the core-thread-pressing surface 62 and a plane PL2 arranged in parallel with the plane PL0 the fastener tape 10 exists may be in a range between 6° and 30°, preferably in a range between 10° and 20°. Acute angle will be referenced as the angle $\alpha$. By forming the core-thread-pressing surfaces 62, 64 as a moderate sloped surface, it would be possible to balance the formation of the aperture area in the core thread holding portion 7 and the reinforcement of the base ends 38 of the legs 31, 32. In some cases, in a direction the legs 31, 32 extend, the length of the core-thread-pressing surface 62, 64 is more than 1.5 times the length of the stopping surface 61, 63 and is less than 2.5 times the length of the stopping surface 61, 63. By increasing the length of the core-thread-pressing surface 62, 64, it would be possible to balance the formation of aperture area in the core thread holding portion 7 and the reinforcement of the base ends 38 of the legs 31, 32.

Advantageously, one or more of the following conditions are satisfied. $2.5<(\theta/\alpha)<7.5$ may be satisfied in which: $\theta$ indicates an angle between the stopping surface 61, 63 and a plane PL1 arranged in parallel with a plane PL0 the fastener tape 10 exists; and a indicates an angle between the core-thread-pressing surface 62 and a plane PL2 arranged in parallel with the plane PL0 the fastener tape 10 exists. Angle $\beta$ between the stopping surface 61, 63 and the core-thread-pressing surface 62, 64 may be in a range between 100° and 135°. Angle between the core-thread-pressing surface 62, 64 and the bottom surface 65 may be in a range between 95° and 110°

When an imaginary line L1 is drawn so as to couple a boundary E5 between the stopping surface 61 and the terminal face 66 of the stopping claw 51 in the leg 31 and a boundary E6 between the stopping surface 63 and the terminal face 67 of the stopping claw 52 in the leg 32, the core-thread-holding portion 7 is defined to have a hexagonal aperture. The core thread holding portion 7 has six corners E1-E6. In a direction orthogonal to the plane PL0 the fastener tape 10 exists, distance between corners E1 and E2>distance between corners E3 and E4>distance between corners E5 and E6 is satisfied.

Brass (CuZn alloy) has been used as material of the metal element and has been confirmed to ensure greater strength of the slide fastener 1 against a laterally-pulling force, but it is also increasingly important to explore other metal materials with an aim to increase the cost-competitiveness of the slide fastener 1. In view of this point, in some embodiments, Al or alloy including Al, e.g. Al—Si based alloy and Al—Si—Mg based alloy is employed as raw material of the metal element 20. Al or alloy including Al is cheaper than brass in some cases and would be thus suitable in enhancing the cost-competitiveness of the slide fastener, but it is concerned that the strength of the slide fastener 1 against a laterally-pulling force can be lowered as Al or alloy including Al is softer than brass. Against such technical analysis, Al or alloy including Al is used as material of the metal element 20 in some embodiments. Even in such cases, as long as the metal element 20 is structured according to the present embodiment, the strength of the slide fastener 1 against a laterally-pulling force can be within an allowable range.

Referring to FIGS. 4-7, a process of manufacturing the metal elements 20 and a process of attaching the metal elements 20 to the core thread 12 of the fastener tape 10 will be described. As shown in FIG. 4, Y-shaped bar 200 having a Y-like cross-sectional shape is molded from a metal wire having a circular cross-sectional shape, for example. When molding, a rolling die 6 as shown may be used (note that FIG. 4 does not show every mold being used). By appropriately setting the gradients of the stopping surfaces 61, 63, the Y-shaped bar 200 and the rolling die 6 can be easily separated. Note that the degree of interspace between the legs 31, 32 should not be limited to one shown in FIG. 4.

As shown in FIG. 5, the Y-shaped bar 200 is cut so that an element-plate 20" is obtained, and then the engaging protrusion 41 and the engaged recess 42 are formed by a die 8 and a receiving die 9. As shown in FIG. 6, the core thread 12 of the fastener tape 10 is arranged between the legs 31, 32 of the metal element 20, and the legs 31, 32 are swaged and deformed by a swaging machine to come closer one another. The attachment of the metal element 20 to the core thread 12 is repeated so that the metal elements 20 are attached to the core thread 12 at a predetermined interspace as shown in FIG. 7.

FIG. 8 shows a metal element 20' according to a reference example. The core thread holding portion 7 has an octagonal aperture, and has corners E7, E8 in addition to corners E1-E6. Non-flat core-thread-pressing surface (flat region 62' and sloped region 68') bent at the corner E7 is formed between the stopping surface 61 and the bottom surface 65. Likewise, non-flat core-thread-pressing surface (flat region 64' and sloped region 69') bent at the corner E8 is formed between the stopping surface 63 and the bottom surface 65.

FIG. 9 shows a dotted line which profiles the octagonal aperture of the core-thread holding portion 7 of the metal element 20' shown in FIG. 8. As would be understood from FIG. 9, the metal element 20 shown in FIG. 3 can have the legs 31, 32 with increased thicknesses T31, T32 at the side of base end 38 of the leg 31, 32 compared with the legs of the metal element 20' of FIG. 8. A skilled person in the art may be worried if attachment strength of the metal element 20 to the core thread 12 is reduced because the extent of force of pressing of the core thread 12 is weakened due to a width H2 be greater than a width H1 in the aperture of the core thread holding portion 7. However, according to analysis by the present inventors, it is expected that configuring the legs 31, 32 be capable of resisting the exerted force F2 at the sloped stopping surfaces 61, 63 is given more weight for improvement of the strength of the slide fastener 1 against a laterally-pulling force than pressing harder the core thread 12 itself.

Working Example 1

Y-shaped bar is molded from a metal wire made of Al—Si based alloy, followed by molding metal elements and then attaching, through swaging, them onto a core thread of a fastener tape. Next, a strength of the slide fastener against a laterally-pulling force is measured. Similar experiment was conducted for metal elements made of brass. Metal elements shown in FIG. 3 are used in the working example. Metal elements shown in FIG. 8 are used in the reference example.

| | Working example 1 | Reference example |
|---|---|---|
| Material of metal element | Al—Si based alloy | Al—Si based alloy |
| Strength to resist laterally-pulling force | 580-800N | 360-580N |

Strength against a laterally-pulling force in the working example 1 is greater than that of the reference example.

Based on the above teachings, a skilled person in the art would be able to add various modifications to the respective embodiments. Reference numerals in Claims are just for reference and should not be referred for the purpose of narrowly construing the scope of claims.

| [Reference Signs List] | |
|---|---|
| 10 | Fastener tape |
| 12 | Core thread |
| 20 | Metal element |
| 31, 32 | Leg |
| 38 | Base end |
| 39 | Free end |
| 40 | Head |
| 51, 52 | Stopping claw |
| 61, 63 | Stopping surface |
| 62, 64 | Core-thread-pressing surface |
| 65 | Bottom surface |

That which is claimed is:

1. A metal element attached to a core thread of a fastener tape, the metal element comprising:

a pair of legs sandwiching the core thread; and a head to which the pair of legs are coupled, wherein:

each leg is a cantilever extending toward its free end from its base end coupled to the head and is provided, at the free end, with a stopping claw that has a stopping surface configured to prevent the core thread from moving away from a position between the pair of legs, the stopping surfaces of the pair of legs slanting gradually so as to approach one another in a direction away from the head;

the head is shaped like a cup with engaging protrusion and engaged recess which are arranged in a same axial line, the engaging protrusion protruding from a first side-surface of the metal element which is formed flat across the head and the leg, the engaged recess recessed in a second side-surface of the metal element which is formed flat across the head and the leg, and the second side-surface being provided at the opposite side of the first side-surface;

the legs of the pair of legs are provided with core-thread-pressing surfaces that slant gradually so as to approach one another in a direction away from the stopping surfaces, each core-thread-pressing surface extending from the stopping surface to the base end of the leg; and a thickness of each leg in a thickness direction of the fastener tape gradually increases from the free end toward the base end of the leg in accordance with at least the slanting of the core-thread-pressing surface, wherein an angle between the stopping surface and the core-thread-pressing surface is in a range between 100° and 135°, and a length of the core-thread-pressing surface is at least 1.5 times a length of the stopping surface in a direction the legs extend away from the head.

2. The metal element of claim 1, wherein a first angle between the stopping surface and a plane arranged in parallel with a plane in which the fastener tape exists is equal to or less than 60°.

3. The metal element of claim 1, wherein $2.5<(\theta/\alpha)<7.5$ is satisfied in which:

$\theta$ indicates a first angle between the stopping surface and a plane arranged in parallel with a plane in which the fastener tape exists; and $\alpha$ indicates a second angle between the core-thread-pressing surface and a plane arranged in parallel with the plane in which the fastener tape exists.

4. The metal element of claim 1, wherein when an imaginary line is drawn so as to couple a boundary between the stopping surface and a terminal face of the stopping claw in one leg and a boundary between the stopping surface and a terminal face of the stopping claw in the other leg, a core-thread-holding portion defines a hexagonal aperture.

5. The metal element of claim 1, wherein the first and second side-surfaces are sheared surfaces.

6. The metal element of claim 1, wherein the metal element includes Aluminum.

7. A slide fastener comprising metal elements of claim 1.

8. The metal element of claim 1, wherein the length of the core-thread-pressing surface is less than 2.5 times the length of the stopping surface in the direction the legs extend away from the head.

9. The metal element of claim 1, wherein a second angle between the core-thread-pressing surface and a plane arranged in parallel with the plane in which the fastener tape exists is in a range between 6° to 30°.

10. The metal element of claim 2, wherein a second angle between the core-thread-pressing surface and a plane arranged in parallel with the plane in which the fastener tape exists is in a range between 6° to 30°.

11. A metal element attached to a core thread of a fastener tape, the metal element comprising:

a pair of legs sandwiching the core thread; and a head to which the pair of legs are coupled, wherein:

each leg is a cantilever extending toward its free end from its base end coupled to the head and is provided, at the free end, with a stopping claw that has a stopping surface configured to prevent the core thread from moving away from a position between the pair of legs, the stopping surfaces of the pair of legs slanting gradually so as to approach one another in a direction away from the head;

the head is shaped like a cup with engaging protrusion and engaged recess which are arranged in a same axial line, the engaging protrusion protruding from a first side-surface of the metal element which is formed flat across the head and the leg, the engaged recess recessed in a second side-surface of the metal element which is formed flat across the head and the leg, and the second side-surface being provided at the opposite side of the first side-surface;

the legs of the pair of legs are provided with core-thread-pressing surfaces that slant gradually so as to approach one another in a direction away from the stopping surfaces, each core-thread-pressing surface extending from the stopping surface to the base end of the leg; and a thickness of each leg in a thickness direction of the fastener tape gradually increases from the free end toward the base end of the leg in accordance with at least the slanting of the core-thread-pressing surface, wherein the stopping surface and the core-thread-pressing surface intersect and thereby form a corner comprising two intersecting line segments, the line segments defining an angle being in a range between 100° and 135°, and a length of the core-thread-pressing surface is at least 1.5 times a length of the stopping surface in a direction the legs extend away from the head.

12. The metal element of claim 11, wherein a first angle between the stopping surface and a plane arranged in parallel with a plane in which the fastener tape exists is equal to or less than 60°.

13. The metal element of claim 11, wherein the length of the core-thread-pressing surface is less than 2.5 times the length of the stopping surface in the direction the legs extend away from the head.

14. The metal element of claim 11, wherein a second angle between the core-thread-pressing surface and a plane arranged in parallel with the plane in which the fastener tape exists is in a range between 6° to 30°.

* * * * *